US007559186B2

(12) United States Patent
Smith

(10) Patent No.: US 7,559,186 B2
(45) Date of Patent: Jul. 14, 2009

(54) WRAP AROUND CARTON PACKAGING MACHINE

(76) Inventor: Brenton L Smith, 2504 Aga Dr., Alexandria, MN (US) 56308

( * ) Notice: Subject to any disclaimer, the term of this patent is extended or adjusted under 35 U.S.C. 154(b) by 0 days.

(21) Appl. No.: 11/362,480

(22) Filed: Feb. 27, 2006

(65) Prior Publication Data

US 2006/0162295 A1 Jul. 27, 2006

Related U.S. Application Data

(63) Continuation-in-part of application No. 10/923,644, filed on Aug. 23, 2004, now abandoned.

(51) Int. Cl.
*B65B 43/24* (2006.01)

(52) U.S. Cl. ..... 53/566; 53/232; 53/233; 53/260; 53/563; 53/575

(58) Field of Classification Search ..... 53/566, 53/260, 575, 579, 563, 207, 232, 233
See application file for complete search history.

(56) References Cited

U.S. PATENT DOCUMENTS 3,875,724 A * 4/1975 Langen ..... 53/462
3,879,920 A * 4/1975 Langen ..... 53/506
3,986,319 A * 10/1976 Puskarz et al. ..... 53/447
4,015,403 A * 4/1977 Langen ..... 53/575
4,221,107 A * 9/1980 Langen ..... 53/575
4,250,693 A * 2/1981 Andersson ..... 53/543
4,308,020 A * 12/1981 Langen ..... 493/175
4,571,236 A * 2/1986 Adams ..... 493/319

* cited by examiner

*Primary Examiner*—Thanh K Truong
(74) *Attorney, Agent, or Firm*—Dicke, Billig & Czaja, PLLC

(57) ABSTRACT

A packaging apparatus for wrapping a carton around a packaged product comprises a box mandrel conveyor including a plurality of mandrels which support the packaged product thereon. Packages are precisely fed to the mandrels of the box mandrel conveyor by a conditioning conveyor. Carton blanks are delivered to a conveying system from a carton magazine and are conveyed in vertical confronting relation to a mandrel. Each mandrel moves the carton blank against a plow device thereby causing the carton blank to be folded around a mandrel containing a package. Folding and compression devices are provided for folding and compressing an end panel against a manufacturer's flap. Suitable flap closing means close the end flaps and upper and lower flaps after the mandrel is withdrawn from the carton.

12 Claims, 9 Drawing Sheets

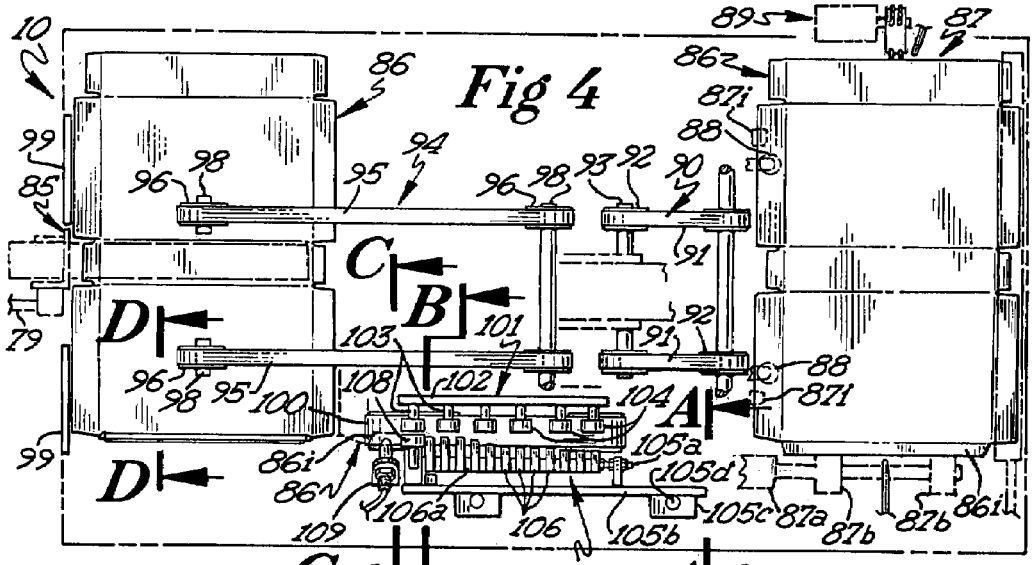
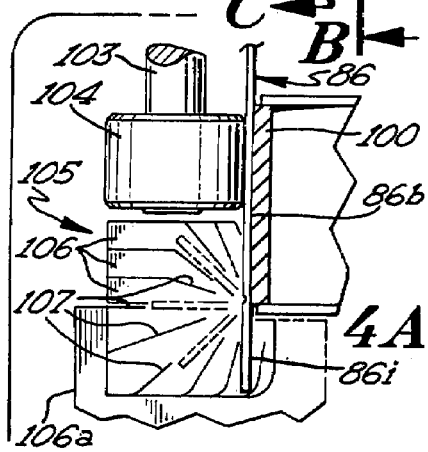
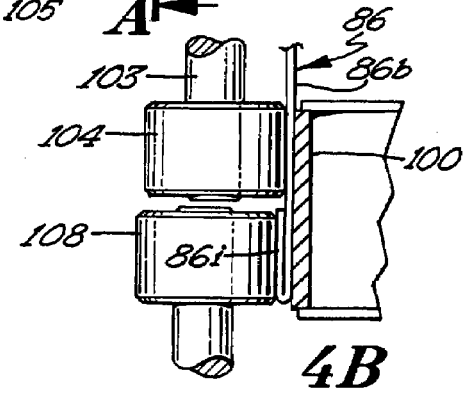
Fig 4, A·B·C·D
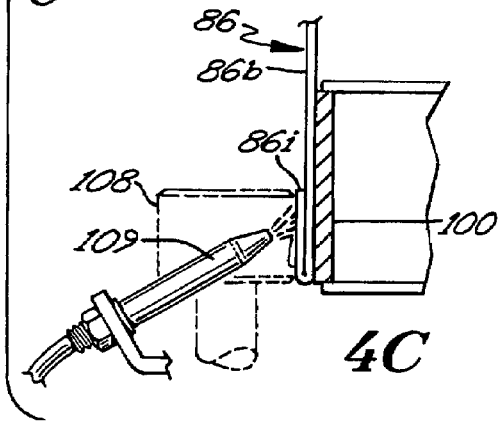
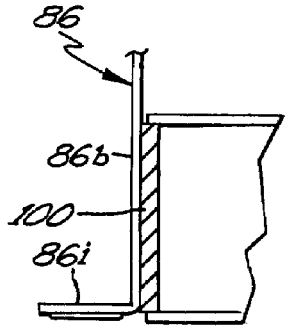

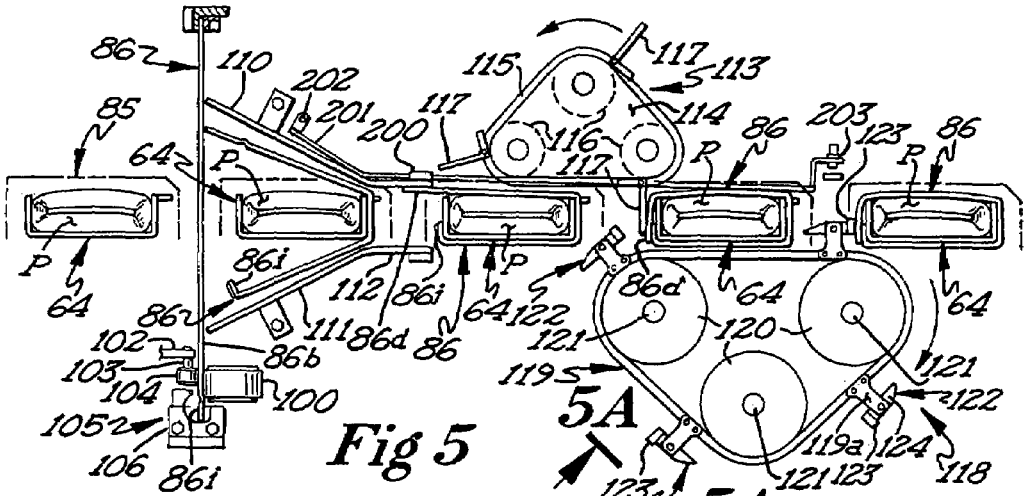
Fig 5
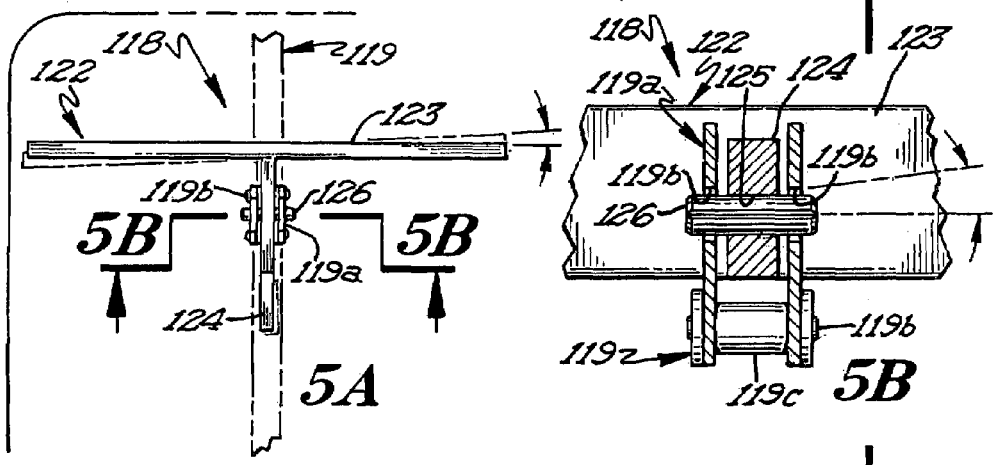
Fig 5, A·B·C
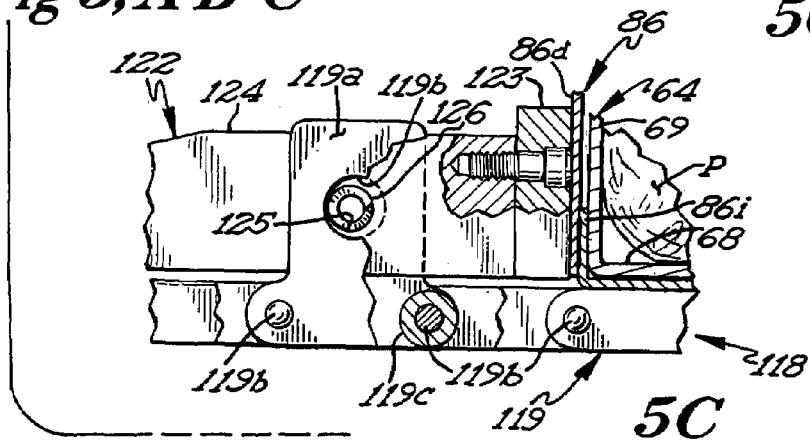

8A
8A

WRAP AROUND CARTON PACKAGING MACHINE

CROSS-REFERENCE TO RELATED APPLICATIONS

The present application is a continuation-in-part of the parent application Ser. No. 10/923,644 which is now abandoned.

FIELD OF THE INVENTION

This invention relates to a packaging machine and more particularly to a packaging machine which, starting with a fully knocked down flat carton blank, removes one carton at a time from a hopper and reliably wraps and forms the carton around a mandrel which contains therein the product to be packaged. Once the carton is partially formed, the mandrel is withdrawn leaving the product to be packaged inside the carton. The carton is then folded and sealed around the product prior to discharging from the machine. This is a continuation-in-part application of U.S. patent application Ser. No. 10/923,644 filed Aug. 23, 2004.

BACKGROUND OF THE INVENTION

It is common practice for the carton manufacturer to preform their carton blanks into a partially assembled container before delivery to their customer. This product has thus come to be called a pre-glued carton. These pre-glued cartons are then traditionally opened by the packaging machinery to receive the articles to be packaged therein. Because this pre-glued blank is more expensive to purchase, takes up more space in storage, is difficult to open, and is difficult to load with product, prior art attempts have been make to develop machinery that can accept fully knocked down "flat" blanks and perform the required packaging function reliably. However, these prior art machines have significant weaknesses.

1) Prior art machines choose to pre fold the blank while it was being conveyed from the carton magazine (or hopper) to the mandrel conveyor, and they choose to pre fold it on the score lines that the mandrel would first contact. This made intuitive sense because it greatly aided in controlling the blank through the folding of the blank around the mandrel. This decision then drove the need to try and fold (tuck) the manufactures joint around the mandrel. This proved to be a costly decision as it is very difficult to perform reliably.
2) Prior art machines choose to try and tuck the manufacture joint around the mandrel. This proved to be unreliable because the flap is so long transversely across the machine and short in length (usually only 0.5"). It also proved very problematic to try and get the manufactures joint tucking devise physically mounted. Room in that area of the machine is very tight and the mounting of the device caused problems in controlling the blank properly during tucking.
3) Prior art machines did not design in a manufactures joint compression mechanism that would adequately compensate for normal machine variations. As the long lengths of chain that the mandrel conveyor and the compression flight were mounted on began to wear, their alignment with respect to each other began to change. One could get the machine to compress the manufactures joint properly when the machine was new, but as it wore in, the compression alignment and force started to change.

4) The rear flight only system that the prior art machines used for transporting the carton thru end flap closing and sealing did not automatically adjust for small variations in the carton size and therefore they were not successful in repeatably producing square cartons. They used static rails to attempt to square the carton back against the rear only transport flight on the conveyor.

So significant are these prior art weaknesses that very few machines were produced and no machines incorporating these technologies are known to be in production today. These prior art methods of wrapping a flat carton blank around a mandrel were simply not reliable.

SUMMARY OF THE INVENTION

An object of this invention is to provide a novel and improved cartoning machine in which carton blanks are partially and precisely formed around product and thereafter the flaps are precisely closed and sealed.

In carrying out the invention, the product is delivered to an infeed system which includes smart belts that constantly senses the presence of product and moves the product to known or predetermined positions. The product to be packaged may be flexible products, rigid products and single and multiple bagged and single products. The carton can be two dimensional or three dimensional in a three, four or six-sided container with open or closed ends. The wrap around carton may be formed of paper, paperboard corrugated paper, micro flute corrugated paper or a polymer. In the embodiment shown, the product to be cartoned is a flexible package containing cereal.

The product is delivered from the infeed conveyor system to a fan feed device where product is timed delivered to a timing conveyor. Product is then delivered to a conditioning conveyor which drops the product into a mandrel or bucket. The conditioning conveyor is provided with flights which compress semi rigid product (cereal packages) into a size slightly smaller than the bucket. Fingers on the flights support the product at the discharge end of the conditioning conveyor and prevent premature dropping of the product into the associated bucket.

1) A magazine section is provided that contains blanks which are die cut. The blanks may be coated, uncoated or laminated stock. The blanks are delivered one at a time into a blank conditioning conveyor that moves the blanks toward the mandrel conveyor. During this movement, a small flap (typically called the manufacturers flap) is folded 180° back against its adjacent panel and squeezed with the proper amount of force. Process glue is applied to the outside of this flap and thereafter the flap is allowed to spring back. This adjustable squeezing force is set so that the flap spring back forms an angle of approximately 90° with the carton body. The manufacturer's flap is now properly conditioned for the sealing processes that will occur as the blank is wrapped around the mandrel. There is no need for a device to tuck the flap around the mandrel like the prior art systems attempted to do. One of the drawbacks of the prior art practice of tucking the manufacture flap after glue is applied is that it allows for the possibility of glue getting on the tucker. Some prior art implementations have applied glue to the inside of the panel that will mate with the manufactures flap to eliminate this problem of getting glue on the tucker. However, now one has an even worse possibility that one might end up with glue on the mandrel should a blank tucking problem occur. When glue is inadvertently applied to a bucket, then the bucket can not be pulled from the carton and the system jams. Either way, glue inadvertently applied to the compression bar or the mandrels starts interfering with the sealing of the cartons manufactures flap. Once the preconditioned blanks are inserted in predetermined sequential timing into the mandrel conveyor from the blank conditioning conveyor, the blanks are folded around the packages and the mandrels by plows that contact the blank as the mandrels are being continuously conveyed downstream.

2) Novel guide elements which engage the edge portions of the blanks are used to insure proper positioning between the mandrels and the blanks during this folding process. Prior art machines do not require these guides because they pre fold the blank along the scores that the mandrel will first come into contact with effectively insuring proper alignment. Our novel process of pre conditioning the manufactures flap effectively removes our ability to pre condition the blank along the scores the mandrel will first contact and thus drives the need for our novel blank guide elements.

Once the plows have partially formed the blank around the mandrel, a flap tucking device makes timed contact with the trailing side panel of the carton to bring it against the manufactures flap. The preconditioned manufactures flap with adhesive previously applied, is already in position to be compressed against this side panel.

3) A novel rotary compression devise is used to reliably compress the manufactures flap against the side panel and against the mandrel. This devise is designed and controlled so that it automatically adjusts to each individual mandrel regardless of slight differences between individual mandrels positions or angles. In the preferred embodiment a precision electrically controlled motion generating device (servo motor) provides the power and control for the compression flights to allow for this automatic adjustment of position and force. Further, in the preferred embodiment, only one compression flight is in contact with a mandrel at any moment in time. This ensures that slight differences in spacing between the mandrels mounted on their conveyor and the compression flights mounted on their conveyor do not cause inconsistent and unreliable manufactures joint compression.

Once the manufactures flap has been securely compressed and sealed, the mandrel continues to move the product and carton down stream away from the manufactures flap compression assembly and into a transport conveyor assembly. Once the sleeve shaped carton is in the transport conveyor, the mandrel retracts out of the carton. A stop plate is employed to strip the carton off of the mandrel as it retracts. Once the mandrel is no longer in contact with the sleeved product, the product is now conveyed thru the carton end flap tucking, folding, and compressing portion of the machine by the transport conveyor assembly.

4) This novel transport conveyor assembly employees only rear flights (no front flight) yet produces predictably square cartons. This is possible through the implementation of a novel self adjusting carton contact device that automatically compensate for minor changes in carton size while applying consistent drag force to ensure that the carton is squarely back against the transport conveyor flight at the proper time in the end flap sealing process.

5) As the transport conveyor assembly is squarely moving the sleeved product through the end flap tucking, folding, and compressing assemblies, novel end flap tuckers are employed to ensure that the product inside the carton does not interfere with the end flap sealing process. This is accomplished by the use of novel lobes properly positioned on the tucker wheels. These lobes protrude into the carton during the tucking process and push the product beyond the score line. This is especially helpful with bagged product as these lobes help ensure that the film seals on the ends of the bag do not get in the way of the flap sealing process.

The sealed carton with the product inside is then discharged from the machine.

BRIEF DESCRIPTION OF THE FIGURES OF THE DRAWINGS

FIG. 4 diagrammatic cross-sectional view taken approximately along 4-4 of FIG. 1 looking in the direction of the arrow and illustrating operation of the flap tucker device and the compression device;

FIG. 4A is a cross-sectional view taken approximately along line A-A of FIG. 4 and looking in the direction of the arrows;

FIG. 4B is a cross-sectional view taken approximately along line B-B of FIG. 4 and looking in the direction of the arrows;

FIG. 4C is a cross-sectional view taken approximately along line C-C of FIG. 4 and looking in the direction of the arrows;

FIG. 4D is a cross-sectional view taken approximately along line D-D of FIG. 4 and looking in the direction of the arrows;

FIG. 5 is a cross-sectional view taken approximately along line 5-5 of FIG. 1 and looking in the direction of the arrows;

FIG. 5A is an elevational view taken approximately along line A-A of FIG. 5 and looking in the direction of the arrows;

FIG. 5B is a cross-sectional view taken approximately along line B-B of FIG. 5 and looking in the direction of the arrows;

FIG. 5C is a cross-sectional view taken approximately along C-C of FIG. 5A and looking in the direction of the arrows;

DESCRIPTION OF THE PREFERRED EMBODIMENT

Figure 1:
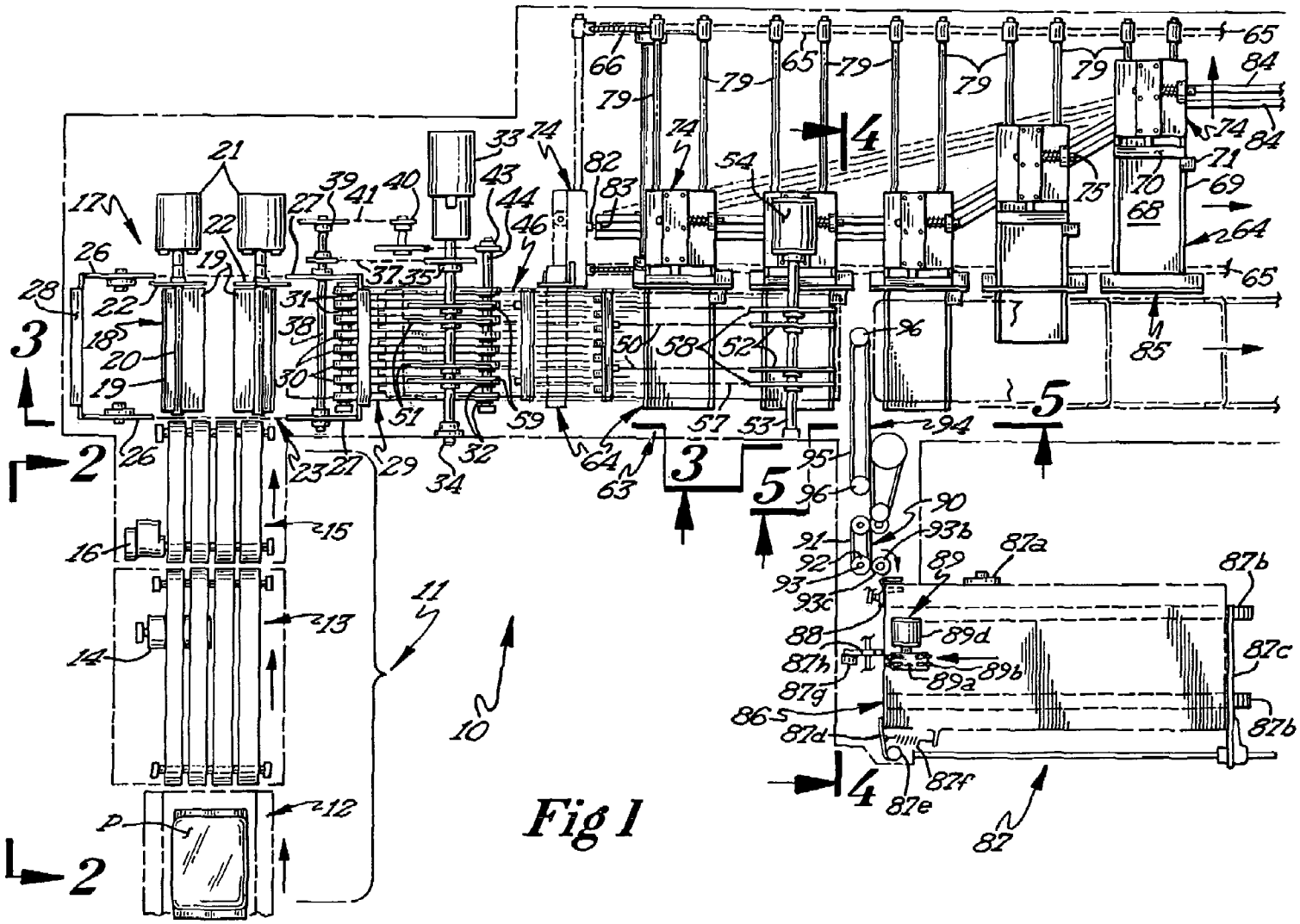
FIG. 1 is a diagrammatic plan view of the novel packaging apparatus.

Referring now to the drawing, and more particularly to FIG. 1, it will be seen that the novel improvements to the wrap around packaging apparatus or machine 10 is there shown. The wrap around apparatus wraps the carton blank around a product rather than inserting the product into a preformed carton. In the embodiment shown, the product is cereal in a poly bag although the novel wrap around packaging apparatus may be used to carton other types of product.

As used herein, the term blank refers to a single piece of packaging material that has been shaped, sized and scored in preparation for use in a packaging process. Various components of the apparatus are driven by precision electrically controlled motion generating devices (PECMGD). Three common types of PECMGD are servomotors, stepper motors, and variable frequency drive motors (VFD). There are also other types of PECMGD but servomotors and VFD motors are preferred in the embodiment shown.

The term mandrel as used herein comprises a rigid structure that serves as a conveying element when attached to a conveyor for conveying a product. The mandrel also provides the necessary uniform structural integrity for wrapping a blank around the mandrel and for compressing the flaps of the blank against surfaces of the mandrel.

The apparatus includes an infeed system 11 which receives the product P from a table top conveyor 12. It is pointed out that table top conveyors 12 or other types of conveyors are provided by the packager and are not, per se, part of the packaging infeed system. The product P is discharged from the tabletop conveyor 12 upon a metering and phasing conveyor 13 which is driven by a servomotor 14. In the embodiment shown, all of the various components of the apparatus are driven by servomotors which are controlled by a computer. A suitable software program controls the sequencing (operational speeds and timing) of the various components.

The metering and phasing conveyor 13 discharges the packages P upon a launch conveyor 15 which is driven by a servomotor 16. The metering and phasing conveyor is a "smart" conveyor and is provided with sensors (not shown) which monitor the product being conveyed. The packages are impelled or launched from the launch conveyor 15 to a fan device 17. The fan device 17 is comprised of two bladed fans 18 each including three blades 19 secured to a hub or axle 20. The hub or axle 20 for each fan is secured to the output shaft of a servomotor 21. In the embodiment shown each fan is driven by a separate servomotor 21.

Figure 2:
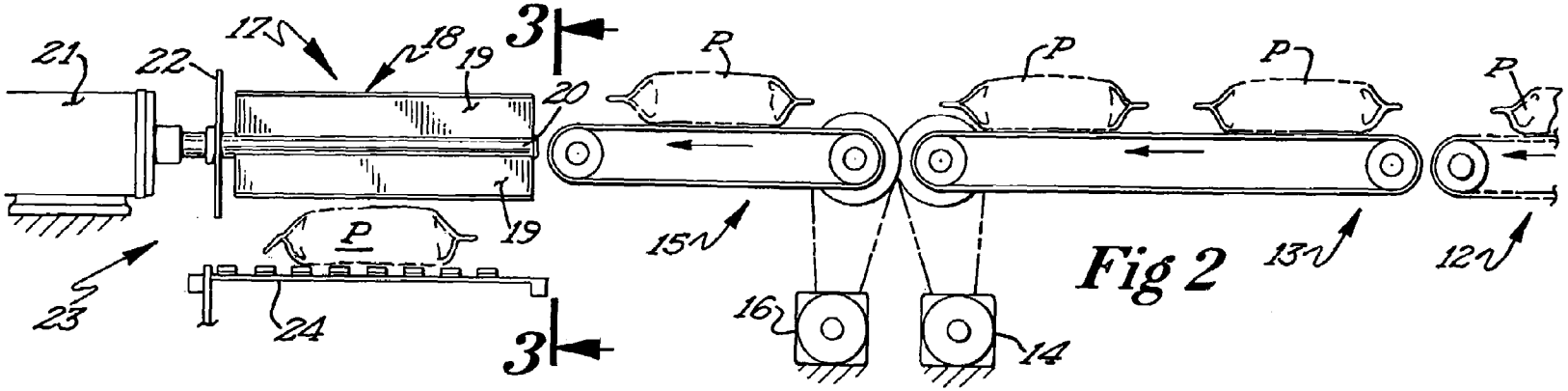
FIG. 2 is a diagrammatic side elevation view taken along line 2-2 of FIG. 1 and looking in the direction of the arrows.

The blades 19 for each fan are angularly spaced apart 120° and the two servomotors 21 operate at the same speed which rotates the fans 18. A pair of circular impact plates 22 are each secured to one of the axles 20 and are located adjacent the associated servomotor 21. With this arrangement, each package P will be launched or impelled from the discharge end of the launch conveyor 15 against the impact plates 22 and fall upon a pair of rotating fan blades 19. It will be seen in FIGS. 2 and 3 that each product is delivered to the fan device 17 from the launch conveyor 15 and is then deposited by the fan device on a timing conveyor 23.

The timing conveyor 23 includes a horizontal table 24 positioned below the fan feed device 17 for receiving the products P thereon. The products P are oriented longitudinally along the infeed conveyor system, i.e., the sealed ends are arranged in the direction travel. It will be noted that the products P are delivered by the fan feed device such that the products extend transversely of the direction of the travel of the timing conveyor. The fan feed device 17 times the delivery of the product to the timing conveyor 23.

The timing conveyor 23 also includes a pair of endless conveyor chains 25 each trained about an upstream sprocket 26 and a downstream sprocket 27. Conveyor flights 28 extend transversely between and are secured to the conveyor chains 25. It will be seen in FIG. 3 that in their lower under passing run, the flights engage the packages and move the packages downstream to a fingered launch conveyor 29.

The fingered launch conveyor 29 is comprised of a plurality of laterally spaced apart narrow conveyor belts trained about upstream pulleys 31 and downstream pulleys 32. It will be noted that the fingered launch conveyor is horizontally disposed and is positioned just downstream of the discharge end of the table 24. Products P are moved by the flights 28 downstream to the fingered launch conveyor.

The timing conveyor 23 and the fingered launch conveyor 29 are both driven by a servomotor 33. The output shaft 38 of the servomotor 33 has one end journaled in a suitable bearing and has sprockets 27 and sprocket 39 keyed thereon. Sprocket 39 is drivingly connected to a sprocket 40 by a chain 41. It will be noted that the sprocket 39 is larger than sprocket 40. The shaft 40*a* mounting sprocket 40 also has a larger sprocket 42 keyed thereto. A chain 44 is trained about sprocket 42 and a smaller driven sprocket 43 which is keyed to the driven shaft 45 for the downstream sprocket 32 of the fingered launch conveyor 29. It will be noted that the relative operational speeds of the timing conveyor and fingered launch conveyor are not only determined by the servomotor 33 but also the particular construction and arrangement of the sprocket drive train.

Figure 3:
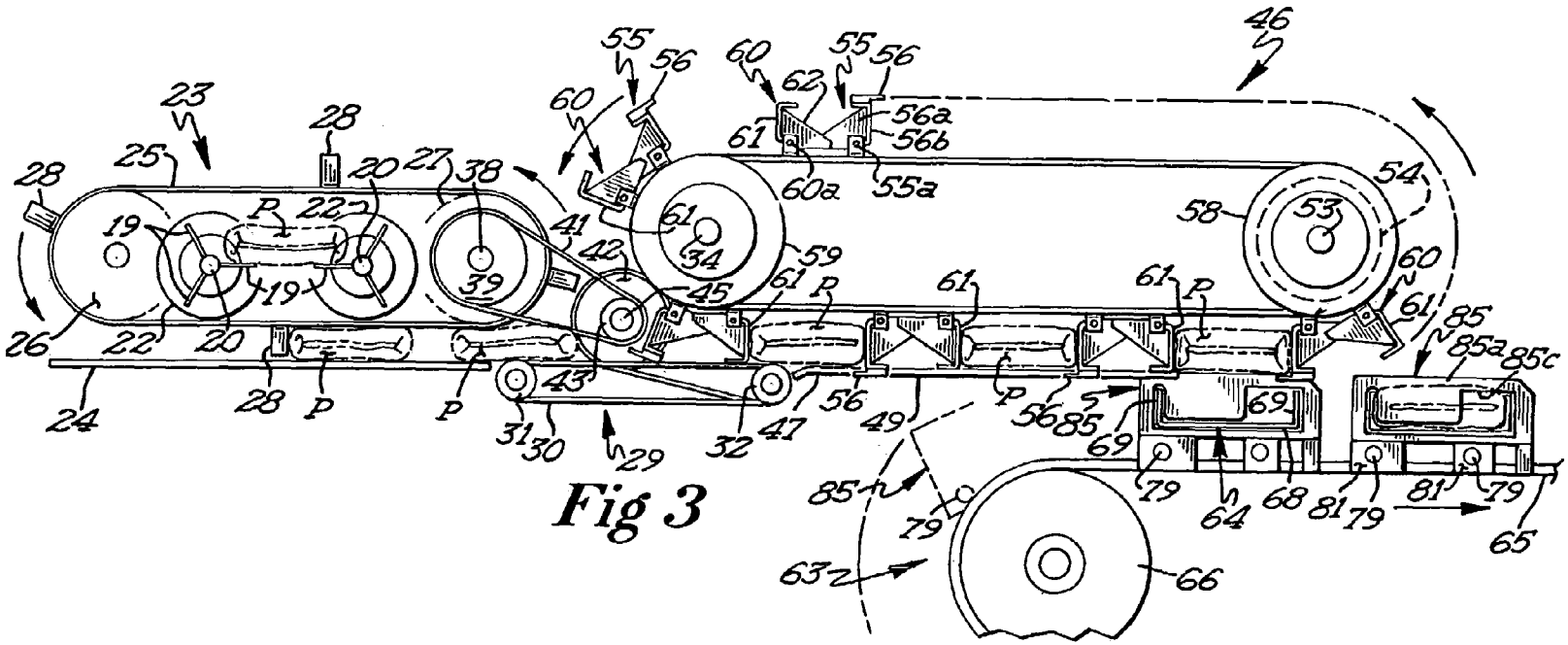
FIG. 3 is an elevational taken along line 3-3 of FIG. 2 and looking in the direction of the arrows.

The fingered launch conveyor 29 consists of a plurality of spaced apart belts 30 trained about the sprockets 31, 32 and the launch conveyor delivers the products P to the conditioning conveyor 46. The conditioning conveyor is driven by a servomotor 33*a*. The conditioning conveyor 46 includes a flat slatted table 47 wherein the slats 49 correspond in number and width to the belts of the fingered launch conveyor 29. Products P are delivered to the conditioning conveyor by the fingered launch conveyor and are supported on the slatted table 47. The upstream ends of the slats 49 are down turned, as best seen in FIG. 3, to facilitate the transfer.

The conditioning conveyor 46 also includes means for moving, compressing and precisely dropping the compressed packages into the mandrels where the blanks are wrapped around, folded and glued to encase the packages. A pair of laterally spaced apart, endless chains 50 are each trained about one of a pair of drive sprockets 51 keyed to the output shaft 34 of the servomotor 53. The chains 50 are also trained about a pair of idler sprockets 52 journaled on the output shaft 53 of a servomotor 54.

The chains 50 have a plurality of finger flights 55 pivotally secured thereto by pivots 55*a*. Each flight 55 has a plurality of fingers 56 projecting there from. These fingers 56 are horizontally disposed during their lower run as shown in FIG. 3 and extend in an upstream direction. The fingers 56 pass between adjacent slats 49 of the slatted table 47 and underlie the leading edge portion of the product P as best seen in FIG. 3.

Each finger flight includes a pair of mounting brackets 56*a* having a plate 56*b* interconnecting the brackets 56. The fingers 56 are secured to a flange on the plate 56*b*. The plate 56*b* for each finger flight is engaged by the leading surface of a package P as clearly shown in FIG. 3.

The conditioning conveyor 46 also includes a pair of endless chains 57 which are laterally spaced apart and are trained about a pair of drive sprockets 58 keyed to the output shaft 53 of the servomotor 54. The chains 57 are also trained about a pair of idler sprockets 59 journaled on the output shaft 34 of the servomotor 33. The chains 57 have a plurality of compression flights 60 pivoted secured thereto by pivots 60*a*. Each flight includes a pair of mounting brackets 62 each pivoted to an associated chain. A compression plate 61 extends between and is secured to the brackets. It will be seen that the conditioning conveyor 46 is operable to move products downstream to the bucket or mandrel conveyor 63. As products P are moved downstream (FIG. 3), each product will be compressed between a plate 56*b* of a finger flight 55 and a compression plate 61 of a compression flight 60. Products P are compressed to reduce the transverse dimension of each package sufficiently so that the transverse dimension of each package is slightly less than the corresponding dimension of a mandrel 64.

As products reach the end of the slatted table, the fingers of a finger flight 55 will support each package as the package moves beyond the table. The mandrel conveyor 63 operates at the same operational speed as the conditioning conveyor. The movement of products P by the conditioning conveyor 46 is synchronized with the mandrel conveyor such that when each product P is released from the conditioning conveyor the package will precisely drop into a mandrel 64. Specifically, each product will be held between a compression flight and a finger flight as the product moves downstream of the end of the slatted table. The fingers support the leading edge of each product against tilting, and the fingers of a flight move quickly away from the supported package as the flight changes direction traveling around the downstream sprockets. This allows each product to be precisely dropped into a mandrel 64. The slatted table 47 is longitudinally adjustable for accommodating product of different sizes. Thus the slatted table 47 can be adjusted longitudinally in an upstream or downstream direction.

Figure 6:
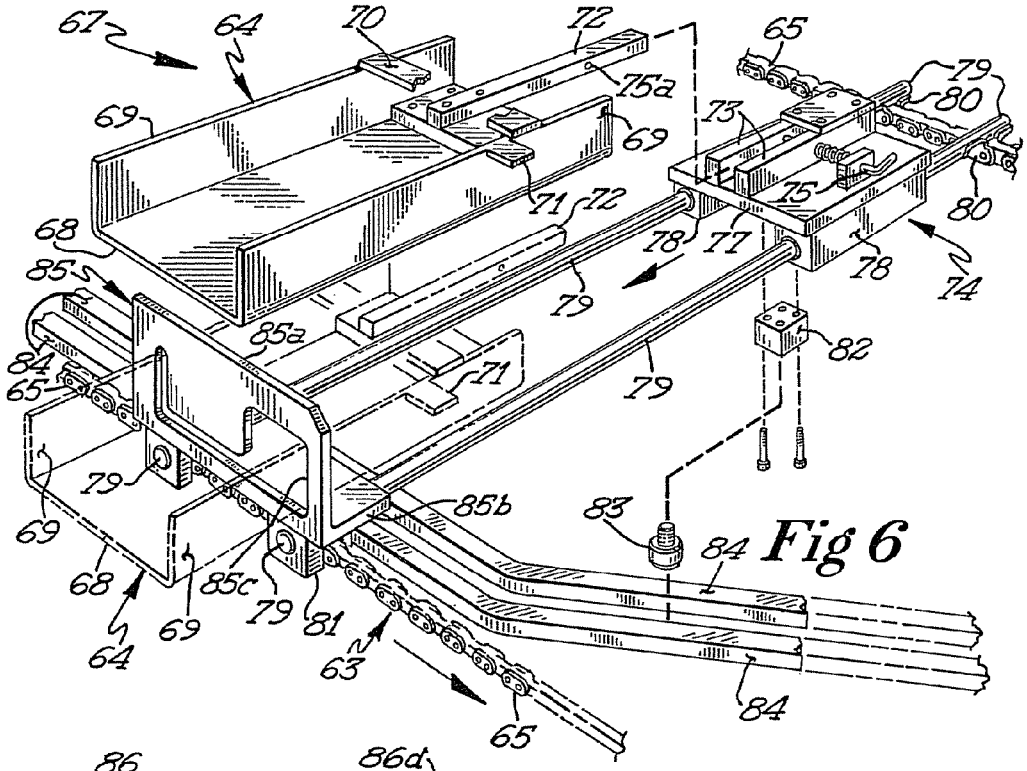
FIG. 6 is a fragmentary perspective view of a portion of the apparatus, exploded, to show details of construction.

The mandrel conveyor 64 includes a pair of endless chains 65 trained about upstream sprockets 66 and downstream sprockets (not shown). A plurality of mandrel assemblies 67 are secured to the chains 65 and are moved thereby. A servomotor (not shown) drives the downstream sprockets and the mandrel conveyor. Now referring to FIG. 6, each mandrel assembly 67 includes a generally rectangular mandrel 64 comprised of a flat bottom wall 68 and upstanding opposed side walls 69. A transverse strap 70 is secured to the top edges of the side walls 69 adjacent the rear edge portion thereof It is pointed out that the front portion of the box mandrel 64 is that end located to the left as viewed in FIG. 6.

Referring again to FIG. 6, it will be seen that each box mandrel 64 has a novel blank flap guide 71 secured to the downstream side wall. One end of elongate quick change mounting arm 72 is secured to mounting plate 73*a* which is secured to the rear end portion of a box mandrel 64. The other end of the mounting arm 72 projects into and is secured to mounting arm receptacle 73 which is a component of a slide block assembly 74. A quick change spring urged lock pin 75 is releasably locked to the mounting arm 72 by engaging an aperture 76 in the arm.

The mounting arm receptacle 73 is secured to a flat plate 77 which is secured to a pair of elongate, transversely extending slide bearings 78. A pair of elongate, spaced apart slide rods 79 each extends through a slide bearing 78 and the rear end of each rod is secured in a bearing block 81 which is affixed to the other drive chain 65. It will be seen that mandrels 64 can be readily changed for accommodating different size products.

It will be seen that each mandrel 64 and associated slide block assembly 74 are moved as a unit downstream but that each mandrel 64 is moved transversely of the direction of travel between on advanced and retracted positions. Referring again to FIG. 6, it will be seen that an apertured spacer block 82 is secured to the lower surface of the bed plate 77 of the slide block assembly 74. The axle of a roller or cam follower 83 is journaled in the opening or aperture of the spacer block 82 for rotation relative thereto.

A pair of spaced apart cam guide tracks 84 are engaged by the cam roller 83 of slide block assembly 74. The disposition of the tracks 84 and the co-action of the cam roller with the tracks produces the transverse movement of the mandrel and slide block assembly. It will be seen that the cam guide tracks 84 change direction from a straight run to a slightly inwardly angled run in a downstream direction. This change in direction produces the transverse movement of the teach mandrel in a retracted direction. The cam guide tracks 84 also change direction in the upstream return direction (a shown in FIG. 1). This change in direction produces the transverse movement of each mandrel in advanced direction.

A stripper plate 85 is secured to bearing blocks 81 of the slide block assembly 74. The stripper plate includes a vertical portion 85*a* and a horizontal portion 85*b*. The vertical portion has a shaped opening 85*c* therein through which the associated mandrel is moved as shown in phantom line configuration in FIG. 6. The enlarged downstream portion of the opening 85*a* allows different size mandrels 64 to be used. During the loading and carton folding steps, each mandrel will be in the advanced position and will project transversely through the opening 85*c* in the stripper plate 85 as best seen in FIG. 1.

Figure 11:
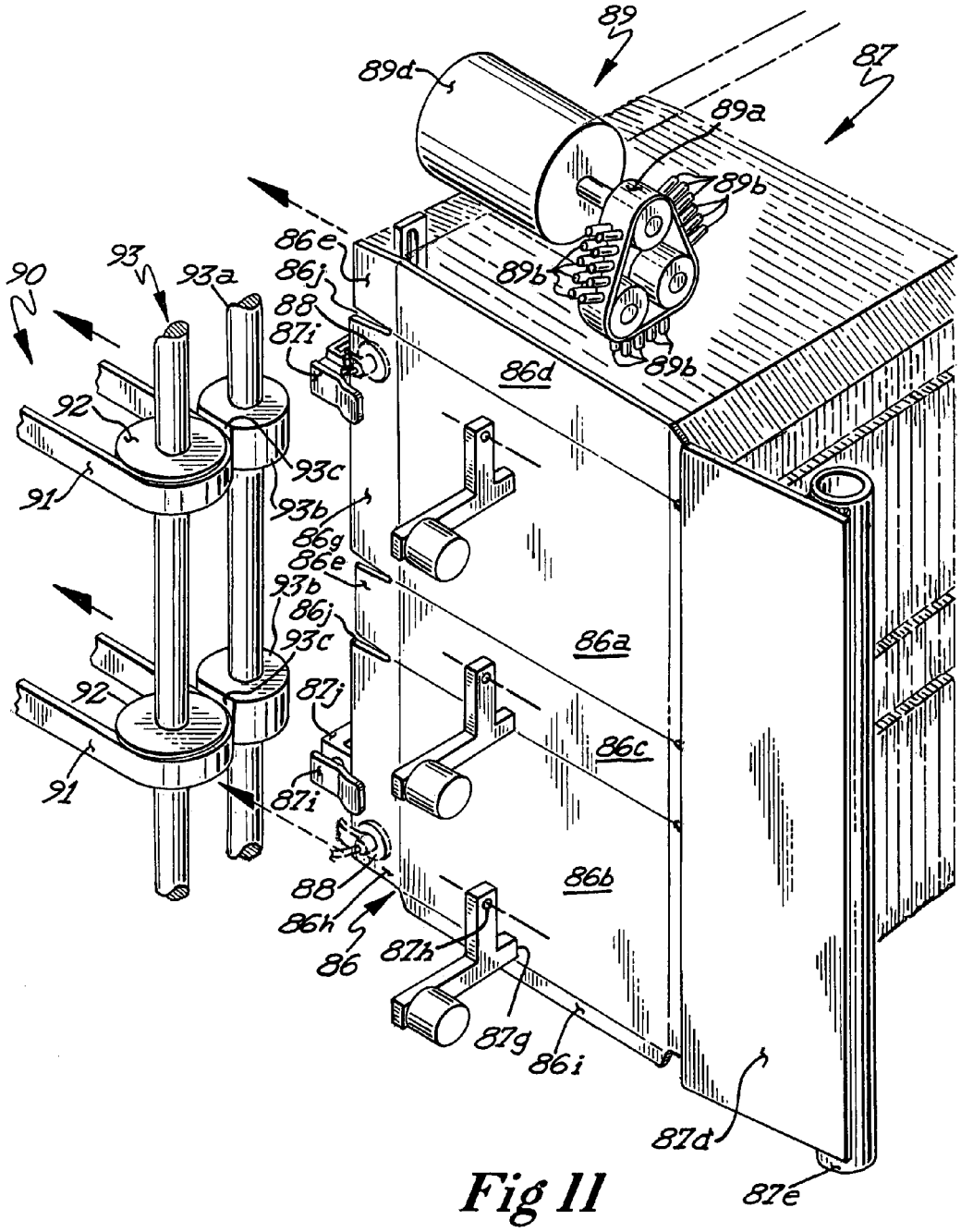
FIG. 11 is a partial diagrammatic perspective view of a portion of the magazine.

Blanks 86 are fed sequentially into the mandrel conveyor from a magazine 87 as shown in FIGS. 1 and 11. The blanks 86 are vertically arranged in the magazine and are fed towards the discharge end by toothed conveyor chains 87*b* which are driven by a servomotor 87*a*. A follower plate 87*c* engages the rearmost blank 86 and moves with the conveyor chains 87*b*.

The discharge end of the magazine 87 as shown in FIGS. 1 and 11 has an outer side and an inner side (closest to the mandrel conveyor) where the blanks are picked or removed one at a time. The outer side of the magazine has a spring loaded plate 87*d* pivotally mounted on the magazine housing by an elongate pivot 87*e*. A spring 87*f* urges the plate 87*d* against the forward most blank. The plate vertically supports the blanks for proper picking by vacuum cups 88 which are moveable about a vertical axis to selectively remove the blanks from the magazine. The yieldable pivotal mounting of the plate 87*d* prevents blanks from binding against the plate.

The magazine also includes a plurality of fingers 87*g* each pivotally mounted by a pivot 87*h* which engage the forward most blank. The fingers are counterbalanced and provide light resistance to forward movement of each blank and thereby prevent the blanks from unduly flopping around as the blanks are removed from the magazine.

The magazine 87 is also provided a rubber finger belt drive assembly 89 located at the top of the magazine. The belt 89*a* is provided with a plurality of rubber fingers 89*b*. The belt 89*a* is trained about pulleys 89*c*, one of which is secured to the output shaft of a servo motor 89*d*. The belt 89*a* moves at a speed slightly greater than the speed of the blanks 86 (conveyor chain 87*b*). The belt 89*a* moves at a speed slightly greater than the speed of the blanks 86 (conveyor chains 87*b*). The fingers 89*b* are arranged in groups and engage tops of the blanks as the fingers flex backward and slide across the top surfaces of the blanks. The resistive force applied by the rubber fingers insures that the top of the blanks are properly positioned up against top clip 87*i*.

The magazine is provided with a pair of clips 87*i* which are vertically spaced apart. The top and bottom clips 87*i* provides resistive force to help separate blank being picked from the one behind it. The lower clip has a sensor assembly 87*j* that signals the conveyor drive 87*a* when to advance the stack of blanks.

Each carton blank 86 is of conventional construction having preformed score lines and appropriate notches. Each blank 86 includes side panels 86*a* and 86*b*, end panels 86*c* and 86*d*, end panel flaps 86*e*, side panel upper and lower flaps 86*g* and 86*h*, and a manufacturer's flap 86*i*. The blank 86 also as preformed notches including notches 86*j*. Referring now to FIG. 4, 4A-4D and FIG. 7 and FIG. 11, it will be seen that the carton blank infeed system includes a relatively short initial belt conveyor 90 comprised of a pair of vertically spaced apart belts 91 trained about pulleys 92 secured to a vertical shaft 93. The conveyor 90 is driven by a servomotor (not shown). The conveyor 90 moves each carton blank inwardly where the carton blank is engaged by a belt conveyor 94.

A nip roller shaft 93*a* is positioned adjacent the outer shaft 93 of the belt conveyor 90 and a pair of nip rollers 93*b* are secured to the shaft 93*a*. Each nip roller has a flat surface or spot 93*c*. The flat surface of each roller 93*b* is positioned so that the blank inserted by the vacuum cups 88 into the nip belt and roller assembly is positioned beyond top and bottom edges and pulled into the nip belt assembly so that the blank remains square.

The nip belt and roller assembly also includes a short conveyor 90*a* which cooperates with the nip roller 93*b* and conveyor belts 90 for moving a blank 86 inward to the mandrel conveyor. The conveyor 90*a* also cooperates with the conveyor 94 for moving a blank towards the mandrel conveyor. It is pointed out that the shaft 93*a* and nip roller 93*b* along with conveyor 90*a* are shiftable as a unit away from the conveyor 90 if a jam occurs. The nip rollers and shaft along with conveyor 90*a* may be returned to its normal operating position after the jam is cleared.

The belt conveyor 94 includes a pair of vertically spaced apart conveyor belts 95 trained about pulleys 96. The outboard pulleys are keyed to a vertical shaft 97 while the inboard pulleys 96 are each mounted on short vertically disposed shafts 98. A servomotor (not shown) drives both conveyors at high speeds so that each carton is rapidly moved inwardly and are stopped by stop plates 99 located inwardly of the conveyor 94 as shown in FIG. 4. Each carton blank 86 will then be in position for folding around the mandrel.

Novel Manufactures Flap Folding

Referring now to FIG. 4, it will be noted that the manufacturer's flap 86*i* is folded and crimped as the carton blank is fed into the mandrel conveyor. The carton blank 86 will be vertically disposed as it moves to the mandrel conveyor and the lower portion of the blank will be engaged by a driven conveyor belt 100 and a roller assembly 101. The roller assembly includes a mounting bar 102 having plurality of roller axles 103. The rollers are transversely aligned and cooperate with the belt conveyor 100 in moving and holding the lower portion of the blank against angular movement during folding and crimping of the manufacturer's flap 86*i*.

A flap folding assembly 105 is positioned adjacent the manufacturer's flap as the blank is conveyed towards the mandrel conveyor. In this preferred embodiment the flap folding assembly 105 includes a plurality a flap folding blocks 106 which are arranged in side-by-side relation and each block has a folding surface 107. Spacer elements 106*a* are positioned between adjacent folding blocks 106. The flap folding blocks are mounted on an elongated rod 105*a* which is secured to a pair of brackets affixed to a mounting plate 105*b*. The mounting plate 105*b* is secured to a pair of mounting blocks 105*c* which are slidable on a pair of rods 105*d*. The flap folding surfaces 107 are arranged such that the manufacturer's flap 86*i* will be progressively folded from its vertical position located in the general plane of the blank (FIG. 4A) upwardly 180° to lie against its adjacent blank panel (FIG. 4B). Immediately there after, the manufactures flap 86*i* is squeezed or crimped against its adjacent panel by roller 108. The crimping roller 108 is located just inwardly of the innermost flap folding element 106 and is mounted on the flap folding assembly 105. Glue is applied by a glue gun 109 to the outer surface of the folded manufacturer's flap 86*i* (FIG. 4C) just before the flap is released by the crimping roller.

After the glue has been applied to the outer surface of the manufacturer's flap 86*i* the blank will be moved against the stop plates 99 releasing the flap from the crimping roller 108. The flap 86*i* will spring back approximately 90° as shown in FIG. 4D. The crimping roller 108 is adjustable so that the squeeze force can be varied as need to insure that the spring back of the flap is approximately 90° with respect to the carton body. By placing the glue on the outside of the manufactures flap 86*i* and by enabling the flap to spring back to the 90° position, the flap is now in position for proper sealing downstream. This novel process of conditioning the manufactures flap also eliminates the need for a manufactures flap tucker. Further, by applying the glue to the outer surface of the manufacturer's flap, and by removing the need for the flap to be tucked, the likelihood of the glue contaminating the buckets and producing jams in the system is substantially reduced if not precluded.

Novel Blank Positioning Rails

Figure 7:
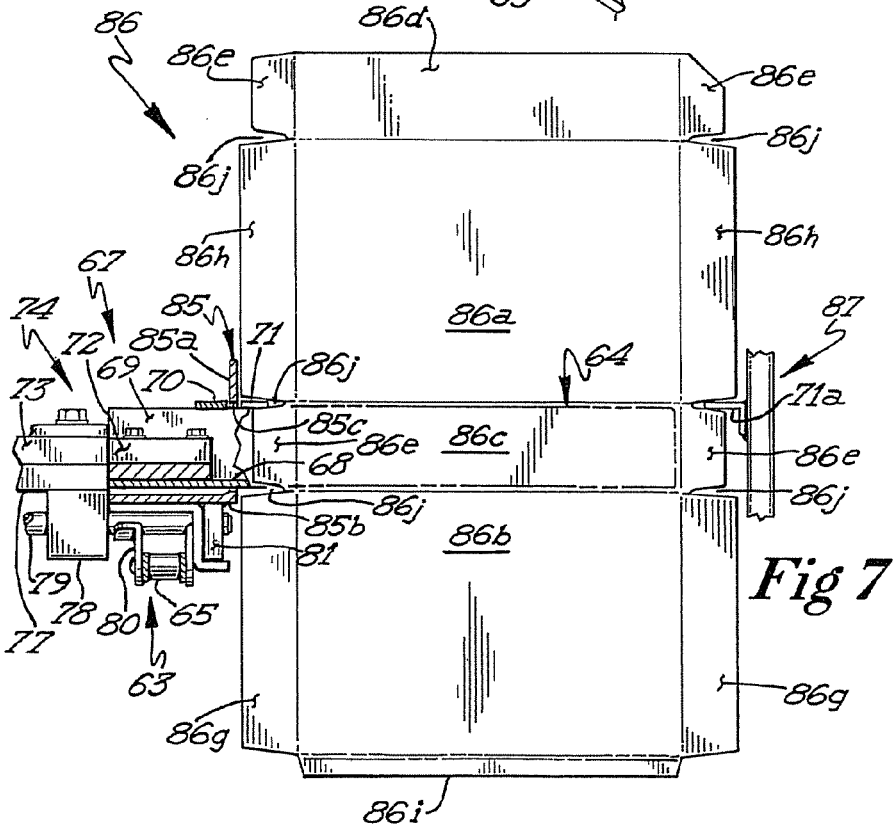
FIG. 7 is a partial front elevational view showing a carton blank and showing adjacent portions of the apparatus in section.

Referring now to FIG. 5 and FIG. 5A thru FIG. 5C and FIG. 6 and FIG. 7, it will be seen that the carton blank 86 begins the folding and sealing operation around each mandrel as the mandrels move downstream. Specifically an end panel 86*c* of a carton blank 86 is engaged by the downstream side wall of the mandrel as the latter moves downstream. The blank is timed delivered into the mandrel conveyor and comes to rest up against stop plates 99 just as the mandrel is starting to make contact with blank panel 86*c*. The flap guide 71 on the mandrel 64 and the flap guide 71*a* on the frame engage in the notches 86*j* of the carton blank as best seen in FIG. 7. The flap guide 71 a is vertically and horizontally adjustable for accommodating different size blanks. With the blank being flat, except for the preconditioned manufactures flap, and vertically oriented these novel guides are critically important for maintaining the proper relationship between the blank and the mandrel during the folding process.

The carton blank engages a plow device including an inclined upper plow 110 and an inclined lower plow 111 which progressively fold the carton against the mandrel. Each plow converges towards the mandrel and terminates in horizontal portions 112. It will be seen that carton will be folded, as shown in FIG. 5, with the end panel 86*d* lying in the plane of the side panel 86*a*. It further be noted that the manufacturer's flap 86*i* will remain in its 90° fold (spring back position) in position for sealing with end panel 86*d*. Each folding plow 110, 111 is a large radius plow for insuring gentle handling of the blank as it is folded around a mandrel.

A flap tucker device 113 is located above the box mandrel conveyor and downstream of the plows 110, 111. The flap tucker device 113 includes a frame 114 which is comprises of spaced apart interconnected opposed plates of generally triangular configuration. In the embodiment shown, endless chains 115 are trained about three sprockets 116. One of the sprockets is driven to move the chains and sprockets in a general counterclockwise direction as viewed in FIG. 5. The chains 115 have flap engaging plates 117 secured thereto and projecting therefrom. It will be seen that the flap engaging plates 117 sequentially engage each end panel 86*d* to fold the end panel 86*d* against the glue coated surface of the manufacturer's flap 86*i* as the flap tucker device is operated. In this regard the flap tucker device 113 is operated by a servomotor (not shown). It will be noted that the flap engaging plates have a flat surface which engages each end panel 86*d*. It will also be seen that three flap engaging plates 117 are provided although this number may vary.

An elongated rail 200 has an upwardly inclined front portion 201 which is pivoted to the frame or side plates of the apparatus by a pivot 202. The major portion of the rail 200 engages the upper surface of the blank which in turn engages the top surface of product P as the blank and product is moved past the flap tucker device 113. The rail 200 is not contacted by the plates 117 and extends beyond the flap tucker device 113. The downstream end of the rail 200 has a sensor device 203 thereon which senses pivoting movement of the rail.

If a product P is oversized or bulging, the product will cause the rail to pivot upwardly and the sensor 203 transmits a signal in response to this movement to inform an operator or other personnel that the oversized product is to be rejected. This pivoting system prevents the occurrence of jams and the sensor informs the system of the need to reject this package.

Novel Manufactures Flap Compression Assembly

Positioned slightly downstream and in partially overlapping relation with the flap tucker device 113 is a compression device 118 as shown in FIG. 5. The novel compression device 118 includes an endless chain 119 trained about sprockets 120 each provided with a shaft 121. One of the sprockets is driven by a servomotor 120*a*. In the embodiment shown, the servomotor 120*a* includes a gear drive 120*b* having an output shaft 120*c* by a belt 120*d* and pulley drive 120*e* to one of the sprockets 120. Referring now to FIG. 5 and FIGS. 5A-5C it will be seen that the compression device 118 includes a plurality of compression flights 122 each comprised of an elongate flat compression bar or plate 123. Each compression bar 123 is rigidly connected to an attachment element 124 extending at a right angle from the center portion thereof. The attachment element has an opening 125 there through for receiving a roll pin 126 therein. The opening 125 is sized slightly smaller than the roll pin 126 so that as the roll pin is forceably inserted into opening 125 it will be held in place by the frictional forces between the two parts. The chain 119 has a plurality of specialized chain links 119*a* (one pair for each compression bar 123). Each link 119*a* has an opening 119*b* which is slightly larger in diameter than the roll pin 126. Each link 119*a* is connected to the next adjacent conventional link by a pin 119*d* having a conventional roll pin 119*c* therein.

Since the openings 119*b* through the modified links 119*a* is larger than the roll pin 126, and since the chain link assembly is largely centered on the compression bar assembly, the compression bar will therefore move into self alignment when compressing the flap 86*i* and end panel 86*d* against the upstream side wall of a mandrel 64. This self alignment feature enables effective compression and sealing of end panel 86*d* and manufacturer's flap 86*i* even if the upstream vertical wall of the mandrel is misaligned with respect to the compression flights.

In the preferred embodiment, the manufactures flap compression device is powered by a servo motor. The novel implementation of this type of drive allows for simple and reliable manufactures joint compression by automatically adjusting for normal machine variations that occur due to manufacturing process variations and machine wear. The servo drive has been programmed so that it is trying to move the compression plate ½ inch beyond the upstream edge of the mandrel. To keep the compression assembly from damaging the mandrel assembly, the torque or force setting of the compression assembly servo motor has been set low enough to not damage the mandrels, yet high enough to provide good compression force. Further, the compression force desired can be easily changed at any time by simply making a software change.

The combination of the pivotal attachment of the compression plates to their drive chain, and the use of a drive that automatically adjusts for mandrel position variations insures that we will have good manufactures joint compression.

Further, it will be seen, that the physical geometry of the compression assembly 118 in conjunction with the drive method described above, that as the compression plate disengages from the carton flaps and mandrel a wiping action is obtained. This wiping action automatically cleans the compression plate of residues.

Further, in the preferred embodiment, there is only one compression plate in contact with a mandrel at any point in time. This design insures that differences in spacing between individual mandrels and individual compression plates do not effect compression.

The blank 86, after the manufactures joint compression and sealing operation, presents an open-ended sleeve around the mandrel containing the product. The small end flaps 86*e* and the large lower 86*g* and upper 86*h* flaps must now be folded and sealed. The mandrels 64 will be sequentially retracted as shown in FIG. 1 after the mandrels have been moved past the compression device 118. As the mandrels are retracted, the sleeve shaped cartons will be prevented from moving with the mandrels by the stripper plates 85.

Novel Rear Flight Only Transport Conveyor System

The sleeve shaped cartons are transferred from the box mandrel conveyor to a novel transport conveyor assembly 127 which is comprised of a pair of chains 128 which are laterally spaced apart and trained about sprockets (not shown) and driven by a servomotor (not shown). It is pointed out that each folded carton is dropped approximately 0.13" from the mandrel 64 upon the chains 128 of the transport chain conveyor.

Figure 8A:
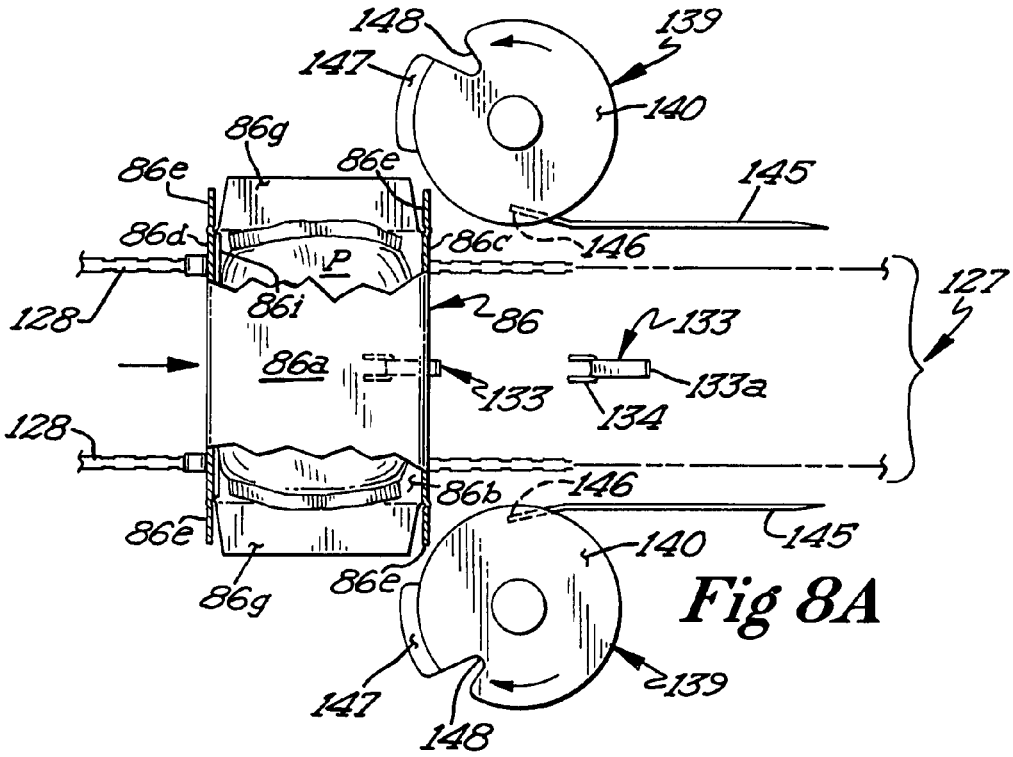
FIG. 8A is a cross-sectional view taken approximately along line 8A-8A of FIG. 8 and looking in the direction of the arrows.
Figure 8B:
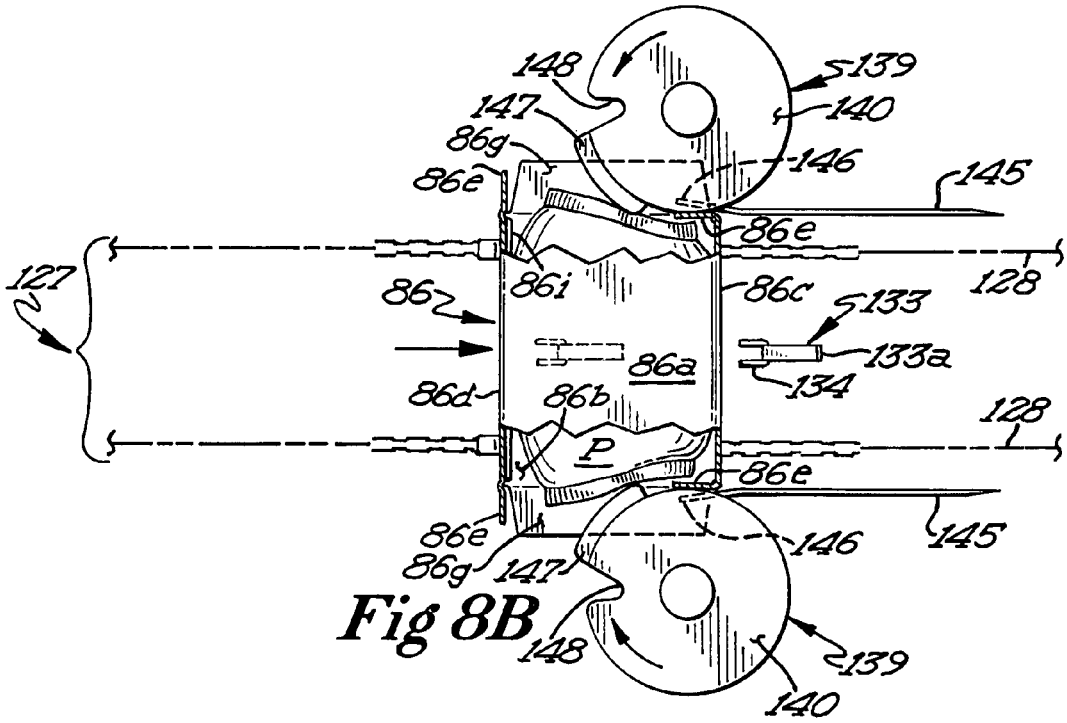
FIG. 8B, FIG. 8C, and FIG. 8D illustrate the sequential steps and mechanism for progressively folding the dust flaps.
Figure 8C:
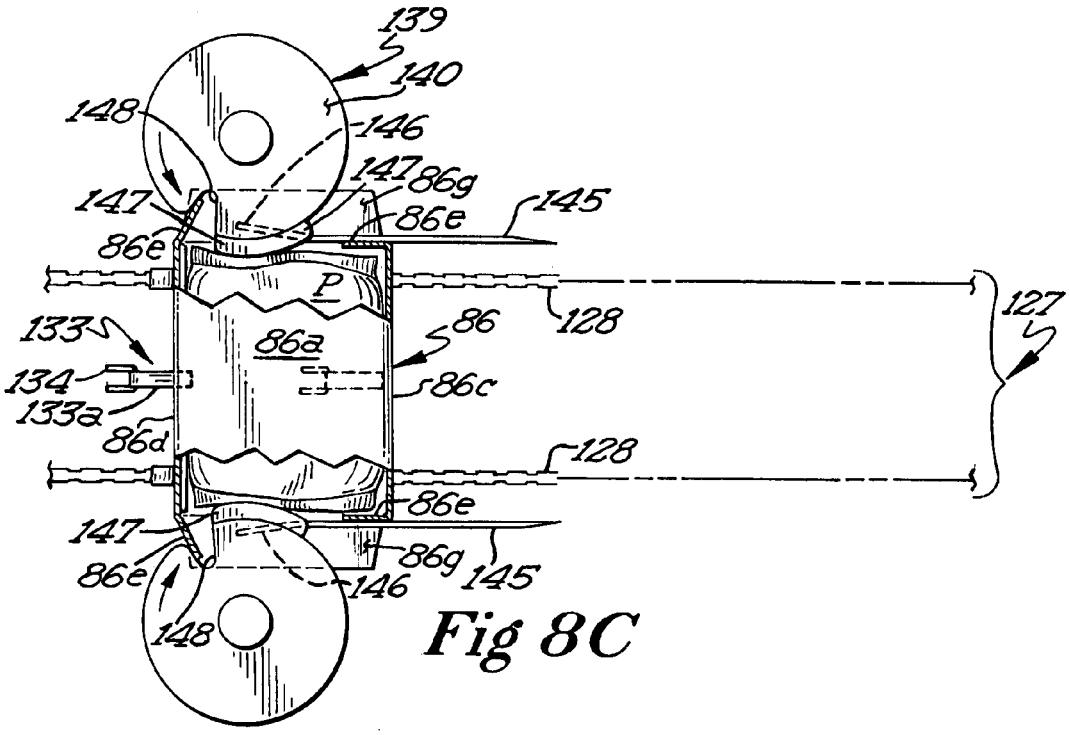
Figure 8D:
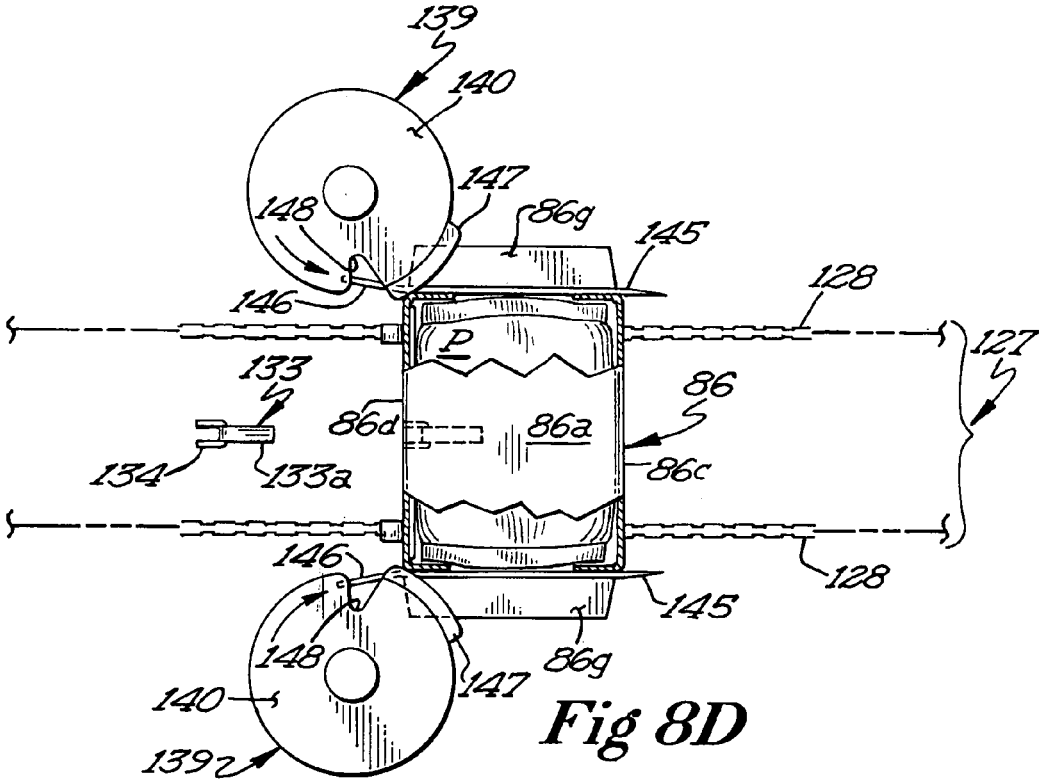
Figures 8, 9, 10:
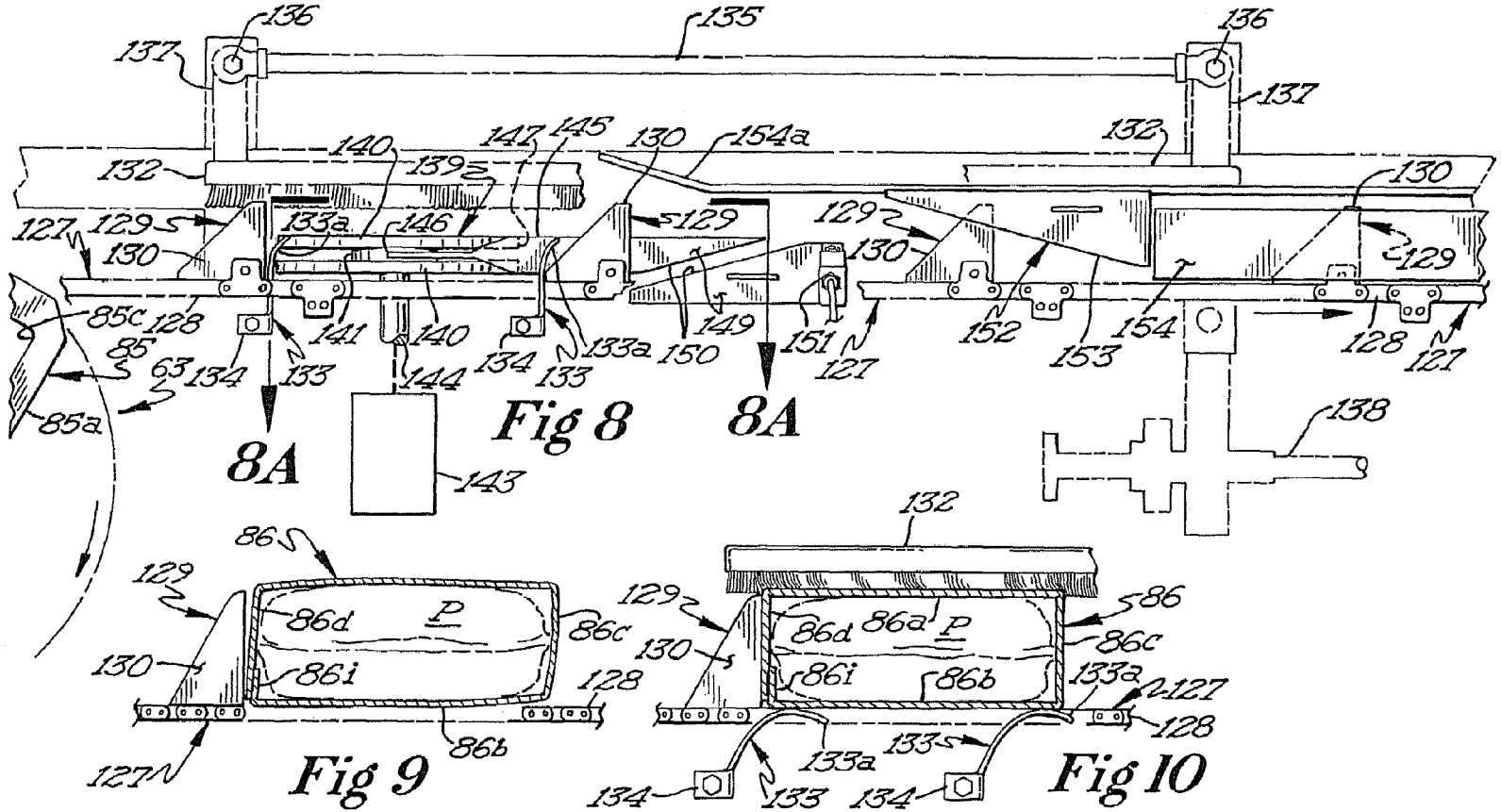
FIG. 8 is a side elevational view of the apparatus located immediately downstream of that portion of the apparatus shown in FIG. 1.
FIG. 9 is a diagrammatic side elevational view illustrating the slightly unsymmetrical configuration of a carton prior to engaging the carton shaping means.
FIG. 10 is diagrammatic view similar to FIG. 9 and illustrating the symmetrical configuration of the carton after the carton is engaged by the carton shaping means.

The transport chain conveyor 127 also includes flights 129 which include a pair of flight elements 130 each squarely secured to a chain. Each carton is engaged by a flight 129 as shown in FIG. 8-FIG. 10 and the cartons are moved downstream. Unlike prior art devices, this novel packaging system creates a carton with a unique configuration. Because the manufactures flap score 86*i* is the only one of the 4 main scores that has been crimped, the carton will have a slightly unsymmetrical or non-squared configuration as it leaves the box mandrel conveyor 63 as best seen in FIG. 9. The sleeve will have a slight forward lean. This slight forward lean helps the process of squaring the sleeve back against the flight. It is important to get the bottom trailing corner up against the flight before you start engaging the top of the sleeve to position the top trailing corner back against the flight.

Referring again to FIG. 8, it will be seen that spring clips 133 are positioned below the chains 128. The spring clips may be formed of spring metal or may be pivoted. In the preferred embodiment one spring clip 133 is pivoted to a bracket and urged to its upward position by a spring (not shown). The other spring clip 133*a* is formed of spring metal. The spring clips 133 exert an upward and rearward force on the carton. Hold down brush 132 will engage an upper panel of the carton and exert a downward and rearward force. The cooperative resistive action between the clips 133, each brush 132 and other components cause the carton to be reliably moved against the flight to square the carton as shown in FIG. 10.

Since the flight is square, the carton is square and the tucking, gluing, and compressing will now produce a consistently square carton.

Novel Tucker Assembly

Referring now to FIG. 8 and FIGS. 8A-8D, it will be seen that means are provided for plowing and tucking the vertical end flaps 86*e*. This means includes a pair of lateral spaced apart identical rotary tucker wheels 139 positioned on opposite sides of the transport chain conveyor 12. Each rotary tucker wheel 139 is comprised of a pair of vertically spaced apart discs 140 rigidly interconnected by a central spacer element 141. An annular space is defined between each tucker disc and the peripheral edge portions are tapered outwardly.

The rotary tucker wheels 139 are horizontal disposed for rotation about a vertical axis. Each tucker wheel 139 is driven by a servomotor 143 whose out put shaft 144 is connected to the associated tucker wheel. A pair of flap holding plows 145 are mounted on each side of the transport chain conveyor 127 just downstream of the rotary tucker wheels 139. Each plow 145 has a reduced end portion 146 which projects into the annular recess of the associated rotary tucker wheel 139 as diagrammatically illustrated in FIG. 8A and FIG. 8B. It will be seen that the holding plows 145 are vertically disposed and that the reduced end portions 146 diverge outwardly.

Each rotary tucker wheel 139 is provided with a lobe 147 on its outer periphery. Each wheel 139 is also provided with a notch in its periphery adjacent the lobe 147. The rotary tucker wheels tuck the vertical end flaps (often called dust flaps). Referring now to FIG. 8A, it will be seen that the small end flaps 86*e* are positioned to be engaged by the rotary tucker wheels. When the leading end flap 86*e* contacts the associated rotary tucker wheel, the wheel speed (angular velocity) is approximately equal to the linear speed of the carton (chain conveyor). The lobes 147 will move inside the carton and pushes the product (FIG. 8B). The reduced end of the holding plow 145 will hold the leading end flap down and the trailing end flap will enter the notch 148.

When the trailing end flap 86*e* enters the notch 148, the rotary wheel will accelerate to approximately twice the carton (chain conveyor) linear speed to properly tuck the end flap forwardly. Once the trailing end flap is tucked, the wheel is decelerated to its base speed. Since the rotary tucker wheels are servomotors driven, the servomotors can automatically adjust and thereby obviate the need for different size lobes. The end flaps 86*e* are folded to the position as shown in FIG. 8D. At this point, the end flaps 86*e* are tucked and the carton squared (FIG. 10), the carton will continue downstream through plows that fold the top flaps 86*h* and the bottom flaps 86*g*, past glue guns, and through side rails that apply pressure to the folded top and bottom flaps.

Referring again to FIG. 8, it will be seen that a pair of lower flap folding plows 149 are positioned downstream of the rotary tucker wheels 139. The folding plows are positioned on opposite sides of the chain conveyors 128 and each plow 149 has an upwardly inclined edge 150 which engages a lower flap 86*g* and progressively folds the flap upwardly. A glue gun 151 applies glue (preferably hot melt) to the outer surface of the folded lower flaps 86*g*.

A pair of upper flaps folding plows 152 are located downstream of the plows 149. Each plow 152 has a downwardly declined edge 153 which engages an upper flap 86*h* and progressively folds the flap downwardly against the glue coated outer surface of the lower flap 86*g*. All of the flaps are now folded and glued, and the carton continues its downstream movement between side rails 154. The side rails are arranged to apply pressure needed to adhere the flaps together. The sealed cartons are then discharged from the carton machine.

SUMMARY

From the foregoing description it will be seen that this novel packaging machine addresses the weaknesses of prior art efforts and brings to bear processes, devises, and controls never before seen. In summary:

1) Novel manufactures flap folding and creasing assembly that preconditions the manufactures flap as the blank is being conveyed from the blank magazine to the mandrel conveyor. This novel devise simplifies the equipment, removes the need for a manufactures flap tucker, prevents glue contamination of the equipment, all helping to insure reliable operation.
2) Novel guide elements for controlling the blank thru the folding process to insure proper positioning of the blank to the mandrel. One of these guide elements is attached to mandrel itself. The other is adjustably attached to the frame adjacent the mandrel conveyor.
3) Novel manufactures flap compression assembly that automatically adjusts to each individual mandrel to ensure reliable compressing of the manufactures joint.
4) Novel carton transport conveyor assembly that provides for reliably squaring and sealing the end flaps of the carton via a conveyor with a rear flight only (no front flight is required). This is made possible through the implementation of novel self adjusting carton squaring devises.
5) Novel tucking of the carton end flaps with special lobes that keeps the product inside the carton from interfering with the flap sealing process.

Thus it will be seen, that a novel wrap around carton packaging apparatus has been provided which provides advantages not present in prior art packaging systems.

What is claimed is:

1. In an apparatus for continuously folding, forming, and sealing carton blanks around a product, including a mandrel conveyor means comprised of a plurality of mandrels moveable in a path of travel, and carton blank dispensing means for dispensing carton blanks with respect to the path of travel, each blank including side panels, end panels, end panel flaps, side panel upper and lower flaps, and a manufacturer's flap secured to an adjacent side panel, each panel having inner and outer surfaces, said apparatus comprising a panel folding and crimping mechanism positioned relative to said path of travel of said mandrel conveyor means and said carton blank dispensing means such that during continuous movement of a blank from the carton blank dispensing mechanism to the path of travel, said folding and crimping mechanism engages and folds the manufacturer's flap toward the adjacent side panel prior to contact of the blank with any of said mandrels.

2. The apparatus as defined in claim 1 wherein adhesive is applied to the outside surface of the folded and squeezed manufacturer's flap as it is being continuously conveyed to the mandrel conveyor.

3. In an apparatus for continuously folding, forming and sealing carton blanks around a product including a mandrel conveyor means comprised of a plurality of mandrels moveable in a path of travel from an upstream direction to a downstream direction, each mandrel including a bottom wall and opposed side walls disposed in an upstream-downstream direction relative to the path of travel, said upstream side wall terminating at an edge opposite said bottom wall, said edge defining a wall thickness and a width, and carton blank dispensing means for dispensing carton blanks one at a time and moving each carton blank into the path of travel of a mandrel, each carton blank including a plurality of panels and having side edges with notches therein, each mandrel having a blank positioning and containment guide plate secured to the downstream side wall of the mandrel and projecting from said downstream side wall in a direction opposite said upstream side wall, wherein said guide plate defines a length in a direction parallel with a direction of said width, said length being less than said width, said guide plate engaging a notch in the corresponding carton blank for maintaining proper position of a vertically disposed blank relative to the mandrel just prior to engagement of the carton blank by the mandrel as they move together through a blank folding process.

4. The apparatus as defined in claim 3 and a second blank guide plate mounted adjacent to the mandrel conveyor and engaging a notch in the vertically disposed blank located oppositely of the notch engaged by the guide plate on the mandrel for maintaining proper position of the vertically disposed blank to the mandrel just prior to engagement of the vertically disposed blank by the mandrel and as they move together through the blank folding process.

5. In an apparatus for continuously folding, forming, and sealing carton blanks around a product, including a mandrel conveyor means comprised of a plurality of mandrels moveable in a path of travel, and carton blank dispensing means for dispensing carton blanks, each blank including a plurality of panels, said apparatus comprising a rotary compression device including elongate compression plates, a pivotable connector, and a rotary drive member including an endless belt, said pivotable connector securing at least one of said compression plates relative to said endless belt to establish a single pivot point of said compression plate relative to said endless belt, wherein said rotary compression device is positioned and configured to interface with an individual blank at least partially wrapped about a corresponding, individual mandrel by one of said compression plates engaging and compressing two panels of said individual blank against each other and against said corresponding mandrel as said corresponding mandrel moves downstream, said single pivot point enabling longitudinal rocking movement of said compression plate.

6. The apparatus as defined in claim 5 wherein a wiping action is created between the carton flaps and the compression plate as each compression plate moves angularly away from and disengages from the flaps, the wiping action automatically and continually cleaning the compression plate surface.

7. The apparatus as defined in claim 5 wherein a precision electrically controlled motion generating device is utilized to power motion of the rotary drive member.

8. The apparatus as defined in claim 5 wherein only one compression plate is in contact with a mandrel at any point in time.

9. An apparatus for forming a blank into a carton around a product, an elongate mandrel conveyor including a plurality of mandrels for containing and conveying product, means for moving the mandrel conveyor from an upstream end to a downstream end, means for folding and sealing a blank into a sleeve around a mandrel containing a product, the sleeve having a pair of upper and lower flaps, and a pair of end flaps at each end, means for retracting the mandrel out of the formed sleeve leaving the product inside at the downstream end of the mandrel conveyor, said apparatus comprising a transport conveyor system downstream of the downstream end of the mandrel conveyor and including:

a transport conveyor for receiving consecutive ones of the sleeves containing product from the mandrel conveyor and for continuing movement thereof in a downstream direction apart from the plurality of mandrels, spaced apart trailing flights squarely attached to the transport conveyor, the transport conveyor system configured and positioned such that each flight engages only an upstream end of a corresponding one of the sleeves, and yieldable means positioned below the transport conveyor and configured to apply a rearward and upward force on each sleeve carried by the transport conveyor to cause each sleeve to be positioned squarely against the corresponding flight while the sleeve end flaps are being closed and sealed.

10. A packaging apparatus for forming a blank into a carton around a product an elongate mandrel conveyor including a plurality of mandrels for containing and conveying product, means for moving the mandrel conveyor from an upstream end to a downstream end, means for folding and sealing a blank into a sleeve around a mandrel containing product, the sleeve having a pair of upper and lower flaps each demarcated from an adjacent panel of the sleeve by a score line, and a pair of end flaps at each end, a transfer conveyor receiving sleeves containing product from the mandrel conveyor and continuing movement thereof in a downstream direction, the transfer conveyor including spaced apart trailing flights engaging only the upstream end of the sleeve, a pair of rotary end flap tucker wheels positioned on opposite sides of the transfer conveyor each being rotatable about a vertical axis, said tucker wheels during rotation thereof engaging and folding the end flaps during the movement of the transfer flight, plow means positioned on opposite sides of the transfer conveyor downstream of the end flap tucker wheels engaging and folding the upper and lower flaps against the associated end flaps at each end of the sleeves to close and form the sleeve into a carton containing a product, said tucker wheels each including a disc and a lobe, the disc defining a circular periphery and notch along the circular periphery, wherein the lobe projects radially from the circular periphery adjacent the notch, and further wherein each of the tucker wheels are positioned and configured to engage a respective one of the downstream end flaps, then push the product into the sleeve beyond the corresponding score line, and then engage a respective one of the upstream end flaps.

11. The apparatus as defined in claim 10 and a precision electrically controlled motion generating device operatively connected to the tucker wheels for rotating the tucker wheels and being programmed to change its rotational speed so that a lobe smaller than the carton opening will project into the opening just behind the leading flap and exit just in front of the trailing flap effectively pushing the product beyond the score line for the entire opening length of the carton.

12. The apparatus as defined in claim 10 wherein the notch is configured for engaging the downstream trailing end flap for folding the trailing end flap.

* * * * *

UNITED STATES PATENT AND TRADEMARK OFFICE

CERTIFICATE OF CORRECTION

PATENT NO. : 7,559,186 B2
APPLICATION NO. : 11/362480
DATED : July 14, 2009
INVENTOR(S) : Brenton L. Smith It is certified that error appears in the above-identified patent and that said Letters Patent is hereby corrected as shown below:

Column 7, line 39, delete "thereof It" and insert
-- thereof. It --, therefor.

Column 10, line 28, delete "thru" and insert
-- through --, therefor.

Column 10, line 39, delete "71 a" and insert
-- 71a --.

Signed and Sealed this

Twenty-second Day of September, 2009

David J. Kappos

David J. Kappos
*Director of the United States Patent and Trademark Office*